US009222158B2

(12) United States Patent
Han et al.

(10) Patent No.: US 9,222,158 B2
(45) Date of Patent: Dec. 29, 2015

(54) METHOD OF PRODUCING PARTICULATE-REINFORCED COMPOSITES AND COMPOSITES PRODUCED THEREBY

(71) Applicant: Purdue Research Foundation, West Lafayette, IN (US)

(72) Inventors: Qingyou Han, West Lafayette, IN (US); Zhiwei Liu, Shijiazhuang (CN)

(73) Assignee: Purdue Research Foundation, West Lafayette, IN (US)

( * ) Notice: Subject to any disclaimer, the term of this patent is extended or adjusted under 35 U.S.C. 154(b) by 120 days.

(21) Appl. No.: 14/084,834

(22) Filed: Nov. 20, 2013

(65) Prior Publication Data

US 2014/0219861 A1 Aug. 7, 2014

Related U.S. Application Data

(62) Division of application No. 13/293,443, filed on Nov. 10, 2011, now Pat. No. 8,613,789.

(60) Provisional application No. 61/411,961, filed on Nov. 10, 2010.

(51) Int. Cl.
*C22C 49/02* (2006.01)
(Continued)

(52) U.S. Cl.
CPC . *C22C 49/02* (2013.01); *C22C 1/02* (2013.01); *C22C 1/1036* (2013.01); *C22C 32/0052* (2013.01); *C22C 47/00* (2013.01);
(Continued)

(58) Field of Classification Search
CPC ..... C22C 49/02
See application file for complete search history.

(56) References Cited

U.S. PATENT DOCUMENTS 3,871,835 A * 3/1975 Bibring et al. ..... 428/539.5
4,885,214 A * 12/1989 Trenkler et al. ..... 428/614
(Continued)

FOREIGN PATENT DOCUMENTS

CN 101391290 A * 3/2009
CN 101775518 A * 7/2010

OTHER PUBLICATIONS

"Particle Size Conversion Table." Sigma-Aldrich. Sigma-Aldrich Co. LLC., Jan. 9, 2013. Web. May 11, 2015.*
CN 101775518. published Jul. 2010. Machine translation.*

*Primary Examiner* — George Wyszomierski
*Assistant Examiner* — Tima M McGuthry Banks
(74) *Attorney, Agent, or Firm* — Hartman Global IP Law; Gary M. Hartman; Michael D. Winter

(57) ABSTRACT

A process for producing particle-reinforced composite materials through utilization of an in situ reaction to produce a uniform dispersion of a fine particulate reinforcement phase. The process includes forming a melt of a first material, and then introducing particles of a second material into the melt and subjecting the melt to high-intensity acoustic vibration. A chemical reaction initiates between the first and second materials to produce reaction products in the melt. The reaction products comprise a solid particulate phase, and the high-intensity acoustic vibration fragments and/or separates the reaction products into solid particles that are dispersed in the melt and are smaller than the particles of the second material. Also encompassed are particle-reinforced composite materials produced by such a process.

16 Claims, 5 Drawing Sheets

(51) Int. Cl.

| | |
|---|---|
| C22C 1/10 | (2006.01) |
| ***C22C 32/00*** | (2006.01) |
| C22C 1/02 | (2006.01) |
| ***C22C 47/00*** | (2006.01) |

(52) U.S. Cl.
CPC ..... *B22F 2998/00* (2013.01); *B22F 2999/00* (2013.01); *C22C 2001/1052* (2013.01)

(56) References Cited

U.S. PATENT DOCUMENTS

| | | | | |
|---|---|---|---|---|
| 6,253,831 | B1 * | 7/2001 | Genma et al. | 164/499 |
| 2003/0175543 | A1 * | 9/2003 | Lo | 428/614 |
| 2012/0177905 | A1 * | 7/2012 | Seals et al. | 428/221 |

* cited by examiner

METHOD OF PRODUCING PARTICULATE-REINFORCED COMPOSITES AND COMPOSITES PRODUCED THEREBY

CROSS REFERENCE TO RELATED APPLICATIONS

This is a division patent application of U.S. patent application Ser. No. 13/293,443 (now issued as U.S. Pat. No. 8,613,789), filed Nov. 10, 2011, claiming priority to U.S. Ser. No. 61/411,961, filed Nov. 10, 2010.

STATEMENT REGARDING FEDERALLY SPONSORED RESEARCH

This invention was made with government support under Contract No. DE-EE0001100 awarded by U.S. Department of Energy. The Government has certain rights in the invention.

BACKGROUND OF THE INVENTION

The present invention generally relates to particle-reinforced composite materials and methods for the production. More particularly, this invention relates to a process of producing composite materials that utilizes an in situ reaction process to produce a uniform dispersion of a fine particulate reinforcement phase.

There is considerable interest in processes for producing particulate-reinforced metal matrix composite (MMC) components for a large array of metals and alloys for the purpose of increasing their strength, hardness, and/or wear resistance. As nonlimiting examples, aluminum alloys and magnesium alloys are relatively lightweight materials that have found increased applications in the defense and transportation industries, and the ability to increase desired properties of these alloys could further expand their uses in these industries.

In-situ methods for forming small particles in molten metals and alloys are the most cost effective methods for making particulate-reinforced metal matrix composites. One of the in-situ methods under development involves the addition of large particles in a molten metal (the term "metal" is used herein to refer to individual metals as well as their alloys). The particles react with the molten metal to form new particles containing elements from the large particles and the molten metal. The newly formed particles are usually smaller but the morphology of these new particles varies depending on the reaction kinetics. As a result, limited types of spherical particles have been formed in molten metals. Furthermore, the reactions occur at extremely high temperatures, and therefore it can be difficult to use these processes to produce high quality, lightweight matrix composites, for example, aluminum or magnesium matrix composites.

Liquid stirring techniques are often employed for dispersing the resultant particles (or the added particles) in the melt. The stirring method is a cost-effective method compared to many other methods, such as ball-milling and chemical deposition. However, stirring methods are typically only capable of dispersing particles larger than ten micrometers. Liquid stirring methods are known to be not generally effective for separating particles smaller than ten micrometers from their agglomerates, breaking up individual particles from their clusters formed during a self-propagating high-temperature synthesis (SHS) process, and breaking up the reaction products (smaller particles) during the chemical reaction of an in-situ direct melt process. It is believed that this limitation is attributable to the insufficiency of shear stresses generated by melt stirring.

On the other hand, high-intensity ultrasonic vibration has been used for separating nano-size particles from their agglomeration in order to disperse these tiny particles in the melt for forming nanocomposites.

BRIEF DESCRIPTION OF THE INVENTION

The present invention provides a process suitable for producing particle-reinforced composite materials through utilizing an in situ reaction to produce a uniform dispersion of a fine particulate reinforcement phase.

According to a first aspect of the invention, the process includes forming a melt of a first material, and then introducing particles of a second material into the melt and subjecting the melt to high-intensity acoustic vibration. A chemical reaction initiates between the first and second materials to produce reaction products in the melt. The reaction products comprise a solid particulate phase, and the high-intensity acoustic vibration fragments and/or separates the reaction products into solid particles that are dispersed in the melt and are smaller than the particles of the second material.

Another aspect of the invention relates to particle-reinforced composite materials produced by a process comprising the steps described above.

A technical effect of the invention is the ability to use high-intensity acoustic (ultrasonic) vibration to break up or separate reaction products (usually small particles) from larger particles initially added into a melt (molten material) during a chemical reaction process. The resultant particles are much smaller than the particles initially added into the melt. The application of acoustic vibration can also encourage the nucleation of particle formation from the dissolved elements in the melt on cooling to form small particles, as well as break up larger reaction products (particles) into smaller ones.

The invention is capable of finding a wide variety of applications for the aerospace, defense, and transport industries, particularly in view of the potential for lightweight metal matrix composites to find increased applications within these industries. Especially with the increased capability for the production of titanium powders, these industries are searching for methods that can make use of these low-cost powders for making lightweight, high strength materials. The technology offered by the present invention is ideally suitable for using titanium powder to form $Al_3Ti$ particulate-reinforced aluminum or magnesium matrix composites. In addition to composites in which intermetallic particulates are dispersed in a metallic matrix, the method can also be used to form other particulate-reinforced composites in which the reinforcement phase is other than intermetallic, for example, ceramic, and the matrix is other than metallic, for example, polymers and ceramics, to yield a variety of metal matrix composite (MMC), ceramic matrix composite (CMC) and polymer matrix composite (PMC) materials reinforced with a particulate phase whose particle size can range from nanosize to micron scale.

In view of the forgoing, the present invention is believed to be a cost-effective method for making composites containing nano-size or sub-micron size particulates.

Other aspects and advantages of this invention will be better appreciated from the following detailed description.

DETAILED DESCRIPTION OF THE INVENTION

The invention generally entails a process by which a material is melted and the resulting molten material is then held at a temperature higher than the liquidus temperature of the material. While a wide variety of materials can be processed with the present invention, suitable materials are chosen on the basis of their ability when molten to react with powders that are added to the molten material. Likewise, suitable powders are chosen on the basis of their ability to react with the molten material to form other types of compounds. In addition, preferred materials for the powders have higher melting temperatures than the molten material. Powders can be added in various manners, such as injected into the melt with a carrier gas or gasses, pushed into the melt using tools, or added loosely on top of the melt. The powder particles may have a particle size of greater than ten nanometers, for example, greater than ten micrometers.

Figure 1:
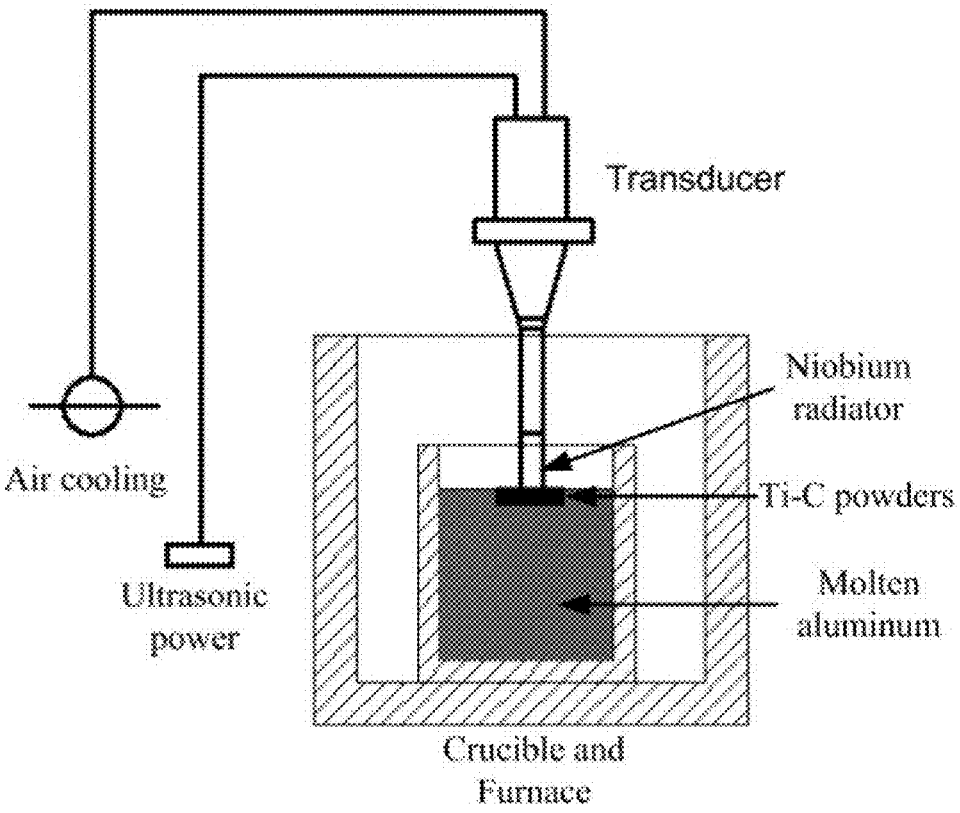
FIG. 1 is a schematic of an apparatus for performing an ultrasonic vibration-assisted direct melt reaction process in accordance with an embodiment of the present invention.

FIG. 1 is a schematic representation of an apparatus adapted to melt a material and then combine a powder with the molten material (melt) to produce a particulate-reinforced matrix composite that contains new particles of compounds that contain elements from the original particles and the melt as a result of the reaction therebetween. As a particular but nonlimiting example, FIG. 1 indicates the material is aluminum (preferably pure), and Ti—C powders are introduced into the molten aluminum to yield an aluminum matrix composite that contains $Al_3Ti$ particles. According to a preferred aspect of the invention, the apparatus of FIG. 1 is also adapted to perform an ultrasonic vibration-assisted direct melt reaction process to promote the formation of new particles having a desired size and distribution in the composite. For this purpose, FIG. 1 represents the apparatus as including an acoustic probe, labeled as a radiator in FIG. 1, which is attached to an ultrasonic horn and transducer. As also represented in FIG. 1, the transducer is preferably cooled with compressed air, though other manners of cooling the transducer are also within the scope of the invention.

Once the powder has been added to the melt, the radiator is used to apply high-intensity ultrasonic vibration to the melt. Suitable power levels and frequencies for the ultrasonic vibration applied to a quantity of a particular material system can generally be identified through routine experimentation. As represented in FIG. 1, the powders are preferably located directly under the radiator, which can be moved around the melt to ensure that the powders are in close vicinity to the probe at one time or another. Though not wishing to be held to any particular theory, the injection of a sufficiently high-intensity ultrasonic fields in a liquid (such as the melt) gives rise to nonlinear effects such as cavitation, acoustic streaming, and radiation pressure. Cavitation, or the formation of small cavities in a liquid, occurs as a result of the tensile stress produced by an acoustic wave in the rarefaction phase. These cavitation cavities continue to grow by inertia until they collapse under the action of compressing stresses during the compression half-period, producing high-intensity shock waves in the fluid. Acoustic streaming is a kind of turbulent flow that is developed near various obstacles (interfaces) due to energy loss in the sound wave. In the context of the present invention, these nonlinear effects can be used to break up the reaction products of a direct melt reaction process from larger particles, and break up agglomerates into constituent particles. Notably, it may be possible to reduce the reaction temperature due to the cavitation phenomenon induced in the melt by high-intensity ultrasonic vibration.

Figure 2:
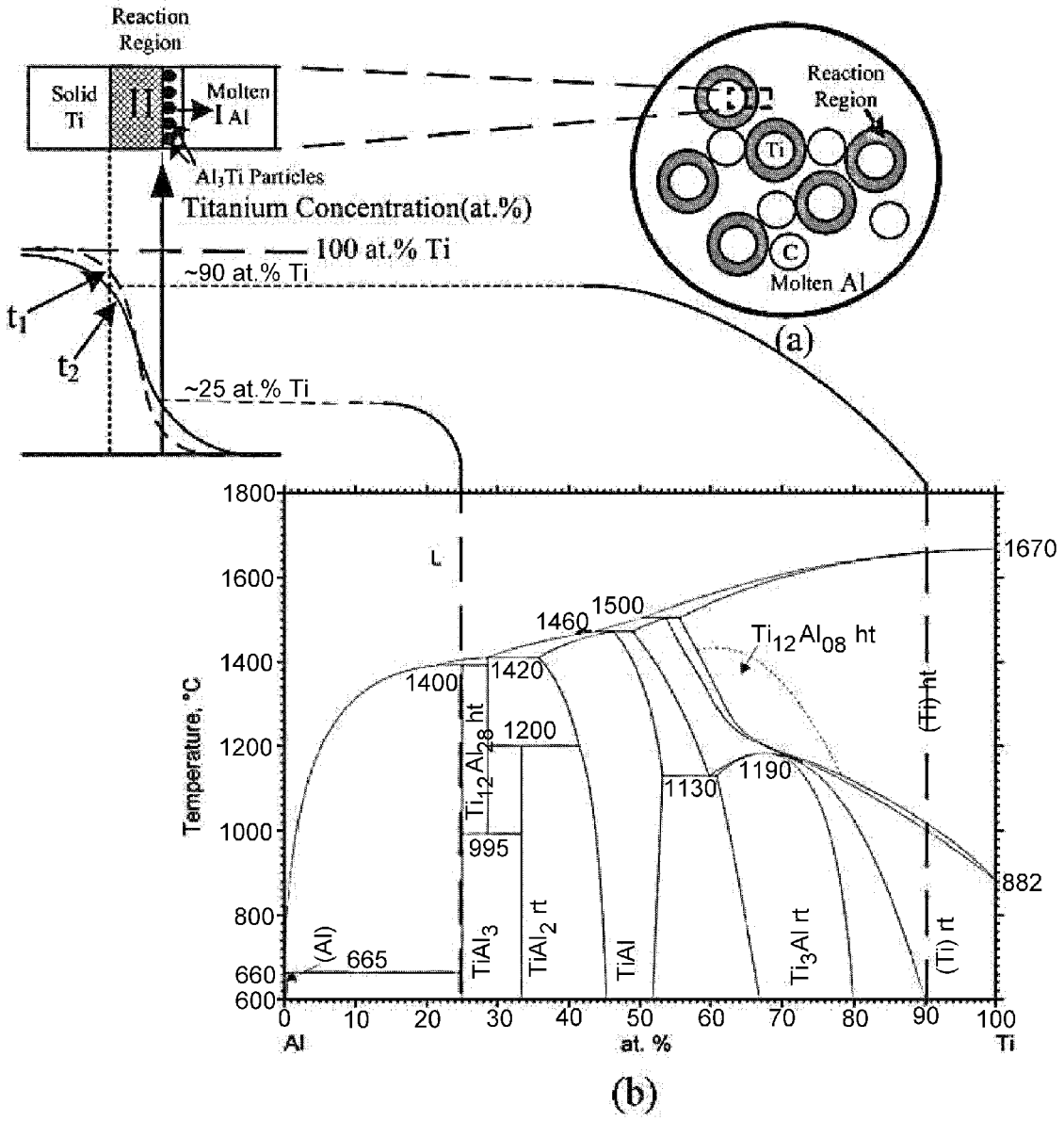
FIG. 2 is a schematic illustration showing a mechanism for the formation of $Al_3Ti$ particles with the process represented in FIG. 1, wherein (a) represents particles and reaction regions, and (b) represents the Al—Ti phase diagram.

The mechanisms for the formation of small spherical or blocky particles as reaction products from larger titanium-containing particles added to an aluminum melt subjected to high-intensity ultrasonic vibration can be understood from FIG. 2. After the powders are added to the molten aluminum held at a temperature above the liquidus temperature of aluminum, for example, about 850° C., reactions commence between titanium in the powders and aluminum in the melt, causing an $Al_3Ti$ phase to form at the surfaces of the powder particles. Meanwhile, a mutual diffusion of elements occurs across the interface between the solid particles and the molten aluminum. Assuming that a single particle is surrounded by molten aluminum, titanium atoms tend to diffuse into the molten aluminum and aluminum atoms in the melt tend to diffuse into the particles to form a layer of $Al_xTi$ on the surfaces of the particles. This process is schematically illustrated in FIG. 2 (with time indicated by $t_1$ and $t_2$). At time $t_1$, the titanium concentration profile in the system is illustrated by the line marked $t_1$. As time increases to $t_2$, the titanium concentration in the particle near the particle/melt interface decreases, as shown by the line marked $t_2$. For the purpose of analysis, one can consider the titanium concentration profile at time $t_2$. If the composition profile at time $t_2$ is combined with the aluminum-titanium phase diagram, two regions can be identified at the particle/melt interface, as shown in FIG. 2. Region I is the portion on a particle near its surface, which is in contact with the molten aluminum. In this region, the titanium concentration is lower than 25 at. % and the phases comprise $Al_3Ti$ and an aluminum-rich phase. In Region II, the titanium concentration is higher than 25 at. % and the phases are mainly $Al_3Ti$, $Al_2Ti$ and AlTi, or pure titanium.

An important feature is that the solid temperature in the Region I is lower than the temperature of the molten aluminum, for example, about 665° C. At least two phases exist in Region I based on the phase diagram: one is the solid $Al_3Ti$ phase and the other is the aluminum rich liquid phase. The fraction of the solid $Al_3Ti$ phase increases from zero to one with increasing titanium until the titanium content reaches 25 at. %. Since Region I is a mushy region containing a liquid-rich aluminum phase, the $Al_3Ti$ phase in this region can be easily broken up and carried away from the titanium particles under the influence of the high-intensity ultrasonic vibration applied by the apparatus of FIG. 1. Furthermore, $Al_3Ti$ phases have limited time to grow before being broken up by the applied high-intensity ultrasonic vibration. As a result, small and spherical $Al_3Ti$ particles tend to form in the melt. These particles can be fragments formed in the Region I and end up in the melt by acoustic streaming, an acoustically-induced fluid flow. Even though some long needle-shaped $Al_3Ti$ particles may be formed in the melt, these particles may also be broken up into fragments by the applied high-intensity ultrasonic vibration. As the further mutual diffusion between titanium and aluminum continues, Region I moves toward the centers of the titanium particles and the $Al_xTi$ phases in Region II will be gradually transformed into $Al_3Ti$ phase in molten aluminum until the original titanium particles are eventually consumed. Furthermore, the $Al_3Ti$ phase tends to become small spherical particles under the influence of the high-intensity ultrasonic vibrations applied in accordance with the invention.

While a pure aluminum melt and titanium powder system are discussed in the example above, the mechanisms described above also apply to other particle/melt systems in which particles are capable of reacting with a given molten material. For example, various other materials can be used for the molten material that will form the matrix of the composite, including but not limited to aluminum with lower purity, aluminum-based alloys, magnesium and magnesium-based alloys, titanium and titanium-based alloys, and nickel and nickel-based alloys. Furthermore, various other materials can be used for the powder material that will react with the molten material to form the reinforcement phase of the composite, including but not limited to metallic, intermetallic and ceramic materials. Particular examples of material systems include but are not limited to adding $Si_3N_4$ particles to a molten magnesium-aluminum alloy to form a reinforcement phase comprising AlN and $Mg_2Si$ particles, adding oxide particles such as $SiO_2$ to a molten magnesium alloy to form a reinforcement phase comprising $Mg_2Si$ and MgO particles, adding $Al_2O_3$ particles to a molten magnesium alloy to form a reinforcement phase comprising MgO particles, adding $TiO_2$ particles to a molten aluminum alloy to form a reinforcement phase comprising $Al_2O_3$, $Al_3Ti$, and AlTi particles, adding particles of a mixed-salt such as $K_2TiF_6$ to a molten aluminum alloy to form a reinforcement phase comprising $Al_3Ti$ particles, and adding $K_2TiF_6$ and $KBF_4$ particles to a molten aluminum alloy to form a reinforcement phase comprising $TiB_2$ particles. While these composites are metal matrix composite (MMC) materials, it is also within the scope of the invention to produce ceramic matrix composite (CMC) and polymer matrix composite (PMC) materials.

The following is an example of an investigation conducted using the technology of the present invention to form spherical $Al_3Ti$ particles in an aluminum melt. The size of the $Al_3Ti$ particles obtained using this invention were smaller than ten micrometers, while $Al_3Ti$ particles obtained in a conventional direct reaction process would typically be about ten micrometers in diameter and over one hundred micrometers long. It is believed that smaller particle sizes can be obtained using the invention by decreasing the temperature of the melt.

In the investigation, pure aluminum (99.5% commercial purity aluminum) was used as the material for the melt and, accordingly, the matrix material for the composite produced by the process. A titanium powder (99.7% purity, average size 40 micrometers), and a graphite powder (99.9% purity, average size 20 micrometers) were mixed at a Ti:C molar ratio of about 1:1. Portions of the mixed powders were then wrapped in aluminum foils and added to the aluminum melt, which was held at a temperature of about 850/C. in a graphite crucible in an electrical resistance furnace. As each portion of the mixed powders was added in the molten metal, the aluminum foils rapidly melted and the ultrasonic radiator was used to apply ultrasonic vibration that pushed the powders deep into the melt. In this particular investigation, the power of the ultrasonic generator was about 1.5 kW and the vibration frequency applied by the radiator was about 20 kHz. The process of adding the mixed powders and applying ultrasonic vibration continued until the final amount of mixed powders added to the melt totaled about 10 wt. % of the combined weight of the powders and melt. Thereafter, the radiator was used to apply ultrasonic vibration for an additional five minutes to disperse the newly formed particles and degas the melt. The melt and its dispersed particle phase were then cast into metal molds to form ingots of aluminum matrix composites.

While adding powders to the molten aluminum, chemical reactions with dazzling bright sparks were observed while the melt was subjected to the high-intensity ultrasonic vibrations. The temperature of the melt was observed to have increased by about 20° C. due to the heat produced by the following exothermic reactions between the powders and molten aluminum:

$$Ti+3Al=Al_3Ti$$

$$Al_3Ti+C=TiC+3Al$$

Phases formed during these reactions were analyzed by X-ray diffraction (XRD, Bruker D8) using $Cu_{6''}$ radiation at about 40 kV and about 40 mA and a scan rate of about 0.0015/s. The microstructural features of the sample were examined by using scanning electron microscopy (SEM, JEOL 6400) equipped with energy dispersive spectroscopy (EDS). The size distribution of the particles was analyzed by using ImageJ software.

Figure 3:
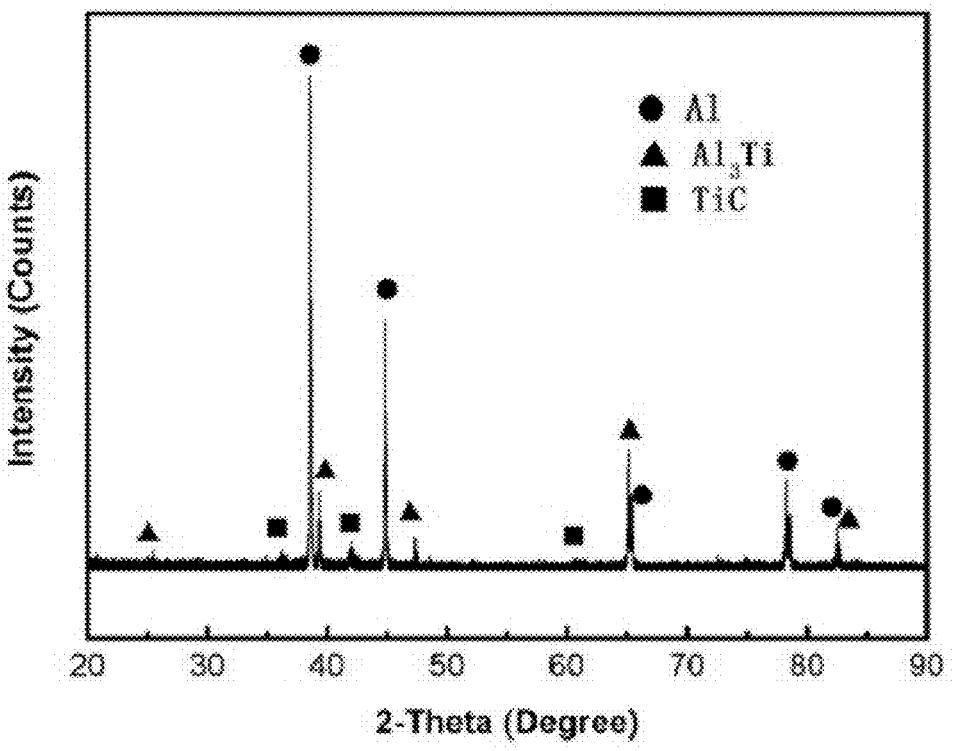
FIG. 3 is an XRD pattern of aluminum matrix composites produced with the processes represented in FIGS. 1 and 2.

FIG. 3 shows the XRD pattern of an aluminum matrix composite produced during the investigation. The XRD pattern indicates that particles formed in the reactions were $Al_3Ti$ and TiC. Strong $Al_3Ti$ peaks and weak TiC peaks are obtained, suggesting that the majority of the particles were $Al_3Ti$ and the content of TiC particles was low.

Figure 4:
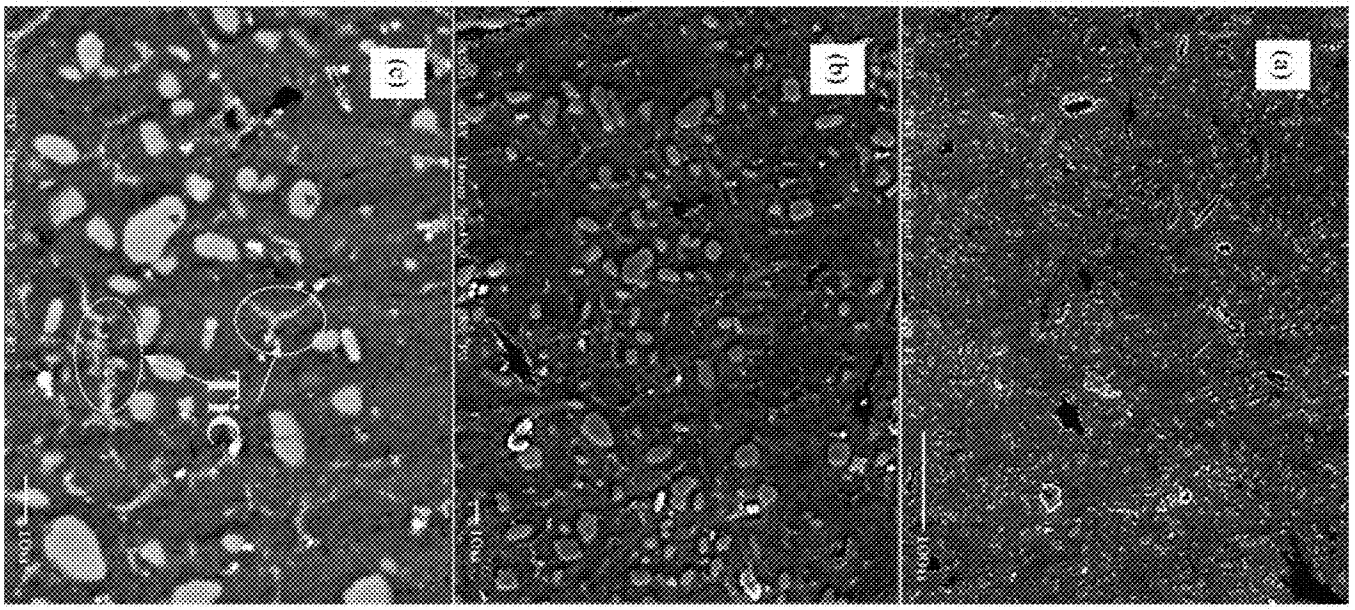
FIG. 4 contains SEM images of aluminum matrix composites produced with the processes represented in FIGS. 1 and 2, wherein the images in (a), (b) and (c) are at magnifications of 200×, 500×and 1000×, respectively.

FIG. 4 depicts three SEM images (a, b and c) of typical microstructures of the aluminum matrix composites produced by the investigation. From the SEM images, it is evident that a homogeneous microstructure of in-situ ($Al_3Ti$+TiC)/Al composites was achieved, and the reinforcement particles were uniformly distributed in the aluminum matrix. The homogeneous distribution of the $Al_3Ti$ and TiC particles in the aluminum matrix was attributed to the stirring effect created by ultrasonic vibration. In particular, though small particles in melts always tend to aggregate together to decrease the free energy of the whole system, with the result that small clusters of small particles formed in the melt during the investigation. Conventional stirring techniques, such as mechanical stirring, would be capable of breaking up large clusters, but would not provide enough shear stress to break up the smaller clusters of ceramic particles in the melt. As discussed above, an important aspect of the invention is to inject an ultrasonic field into a melt that is of sufficiently high intensity to give rise to nonlinear effects in the melt, namely, cavitation, acoustic streaming, and/or radiation pressure. These nonlinear effects, when applied to the melt of the investigation, served to break up reaction products from larger particles, and agglomerate into constituting particles. The ultrasonic vibration applied to the melt was further concluded to have broken up agglomerations of small particles in the melt to yield metal matrix composites reinforced with a fine dispersion of particles, as evidenced by the three images in FIG. 4. While a power of about 1.5 kW and a vibration frequency of about 20 kHz was effective for this purpose, it should be understood that ultrasonic frequencies at greater and lesser intensities can also be effective, depending on the quantity and type of material being treated.

Figure 5:
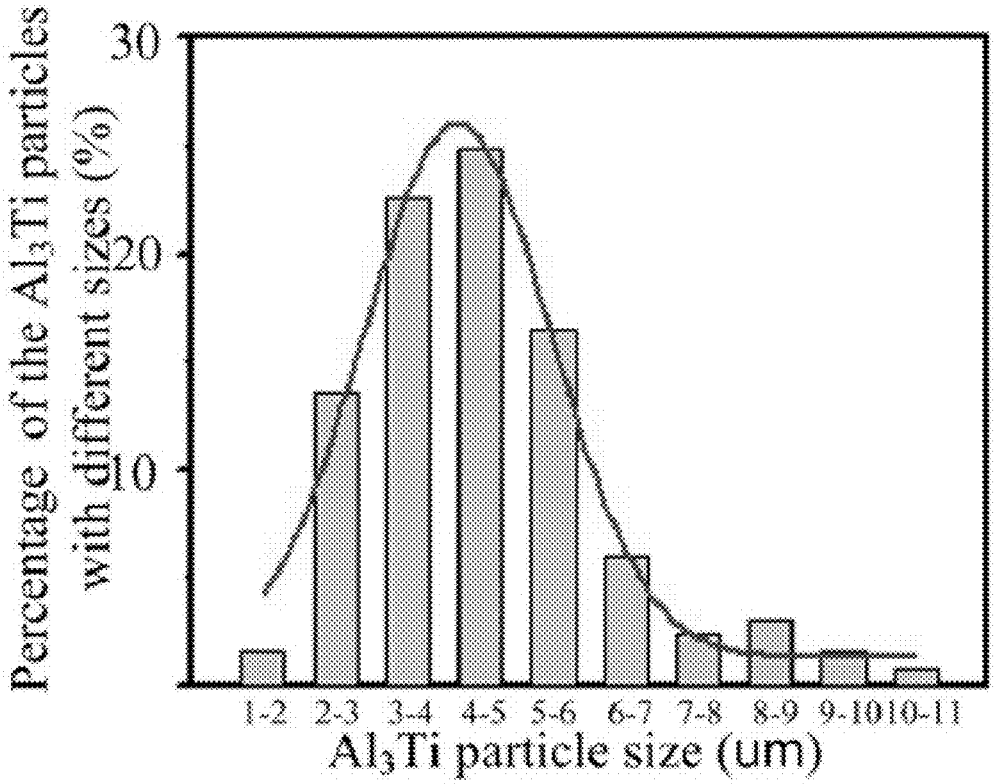
FIG. 5 is a graph plotting the size distribution of $Al_3Ti$ particles in aluminum matrix composites that were produced with the processes represented in FIGS. 1 and 2.

Another important result shown in FIG. 4(*b*) is that the $Al_3Ti$ particles were nearly spherical or blocky, rather than the long rod-like or needle-like particles (lengths of 20 to 30 micrometers) typically reported in the literature. Such a spherical morphology of the reinforcement phase can lead to better mechanical properties in a composite. Moreover, almost all of the $Al_3Ti$ particles were smaller than ten micrometers. Image analysis was carried out to characterize the size distribution of the $Al_3Ti$ particles in several samples. The results, shown in FIG. 5, evidence that about 75% of the $Al_3Ti$ particles were in a size range of about 2 to about 6 micrometers, following Gaussian distribution. The average size of the $Al_3Ti$ particles was about 5 micrometers, which is significantly smaller than the rod-like and needle-like particles reported in literature.

While the invention has been described in terms of specific embodiments, it is apparent that other forms could be adopted by one skilled in the art. For example, vibration power levels and frequencies other than those noted could be employed, processing parameters such as temperatures and durations could be modified, and appropriate materials could be substituted for those noted. Therefore, the scope of the invention is to be limited only by the following claims.

The invention claimed is:

1. A particulate-reinforced composite material produced by a process comprising:

forming a melt of a first material;

introducing particles of a second material into the melt and subjecting the melt to high-intensity acoustic vibration, wherein the particles of the second material have a melting temperature that is higher than the temperature of the melt, wherein a chemical reaction initiates between the first and second materials that produces reaction products in the melt, the reaction products comprising a solid particulate phase in the melt, the high-intensity acoustic vibration fragmenting and/or separating the reaction products into solid particles that are dispersed in the melt and are smaller than the particles of the second material, wherein the first material is aluminum or an aluminum-based alloy and the second material is titanium or a titanium-based alloy and the solid particulate phase and the solid particles formed therefrom comprise $Al_3Ti$, wherein the solid particles are spherical or blocky in shape.

2. The particulate-reinforced composite material according to claim 1, wherein the composite material is a metal matrix composite material.

3. The particulate-reinforced composite material according to claim 1, wherein the first material is aluminum.

4. The particulate-reinforced composite material according to claim 1, wherein the second material is titanium.

5. The particulate-reinforced composite material according to claim 1, further comprising additional solid particles that are dispersed in the melt and comprise TiC.

6. The particulate-reinforced composite material according to claim 1, wherein the solid particles do not have rod-like or needle-like shapes.

7. The particulate-reinforced composite material according to claim 1, wherein the high-intensity acoustic vibration is injected into the melt to have a sufficiently high intensity to induce in the melt at least one nonlinear effect chosen from the group consisting of cavitation, acoustic streaming, and radiation pressure.

8. The particulate-reinforced composite material according to claim 1, wherein the high-intensity acoustic vibration lowers the temperature at which the chemical reaction is initiated between the first and second materials.

9. The particulate-reinforced composite material according to claim 1, wherein the process further comprising the step of cooling the melt, during which additional solid particles nucleate and form from dissolved elements in the melt.

10. The particulate-reinforced composite material according to claim 9, wherein the high-intensity acoustic vibration causes the additional solid particles to fragment and/or separate into additional solid particles that are smaller than the particles of the second material.

11. The particulate-reinforced composite material according to claim 1, wherein the solid particles are spherical.

12. The particulate-reinforced composite material according to claim 1, wherein the second material is added to the melt in an amount of about 5 wt. % of the combined weight of the melt and the second material.

13. The particulate-reinforced composite material according to claim 1, wherein the composite material is a particulate-reinforced aluminum matrix composite.

14. The particulate-reinforced composite material according to claim 1, wherein the particles of the second material have a particle size of greater than ten nanometers.

15. The particulate-reinforced composite material according to claim 1, wherein the solid particles have a particle size of less than ten micrometers.

16. The particulate-reinforced composite material according to claim 1, wherein the solid particles have a particle size of less than one micrometer.

* * * * *